US009995305B2

(12) United States Patent
Golm, Jr. et al.

(10) Patent No.: US 9,995,305 B2
(45) Date of Patent: Jun. 12, 2018

(54) FLUID FLOW APPARATUS, FAN ASSEMBLY AND ASSOCIATED METHOD

(71) Applicants: Regal Beloit America, Inc., Beloit, WI (US); REGAL BELOIT AUSTRALIA PTY LTD., Rowville, VIC (AU)

(72) Inventors: Norman Carl Golm, Jr., Fort Wayne, IN (US); Rachel Barbara Cocks, Columbia City, IN (US); Roger Carlos Becerra, Fort Wayne, IN (US); Michael Allen Marks, Fort Wayne, IN (US); John Sheldon Wagley, Winona Lake, IN (US); Greg Heins, Aspendale (AU)

(73) Assignee: Regal Beloit America, Inc., Beloit, WI (US)

( * ) Notice: Subject to any disclaimer, the term of this patent is extended or adjusted under 35 U.S.C. 154(b) by 621 days.

(21) Appl. No.: 14/505,526

(22) Filed: Oct. 3, 2014

(65) Prior Publication Data

US 2016/0097394 A1 Apr. 7, 2016

Related U.S. Application Data

(60) Provisional application No. 61/888,457, filed on Oct. 8, 2013.

(51) Int. Cl.

| | |
|---|---|
| ***F04D 19/02*** | (2006.01) |
| ***F04D 25/06*** | (2006.01) |
| ***F04D 25/08*** | (2006.01) |
| ***F04D 19/00*** | (2006.01) |
| ***F04D 29/66*** | (2006.01) |

(52) U.S. Cl.

CPC ..... *F04D 25/0653* (2013.01); *F04D 19/002* (2013.01); *F04D 19/007* (2013.01); *F04D 19/024* (2013.01); *F04D 25/0606* (2013.01); *F04D 25/088* (2013.01); *F04D 29/665* (2013.01)

(58) Field of Classification Search

CPC .... F04D 19/002; F04D 19/007; F04D 19/024; F04D 25/088; F04D 25/0653

USPC ..... 417/420, 423.5, 423.7; 416/120, 124, 416/128; 415/66, 68

See application file for complete search history.

(56) References Cited

U.S. PATENT DOCUMENTS 2,031,688 A * 2/1936 Bowen ..... F04D 25/0653 310/112
3,021,696 A * 2/1962 Spiegelinalter ..... F24F 1/02 416/124
3,768,546 A * 10/1973 Shipes ..... F04D 29/362 165/96
4,504,751 A * 3/1985 Meier ..... F04D 25/0653 310/62

(Continued)

FOREIGN PATENT DOCUMENTS

CN 100375850 C 3/2008
CN 101227109 A 7/2008

(Continued)

*Primary Examiner* — Peter J Bertheaud
(74) *Attorney, Agent, or Firm* — John Wagley

(57) ABSTRACT

A fluid flow system is provided. The system includes a rotation producing device, a first fluid flow device coupled to the rotation producing device and a second fluid flow device coupled to the rotation producing device and spaced from the first fluid flow device.

4 Claims, 12 Drawing Sheets

(56) References Cited

U.S. PATENT DOCUMENTS

| | | | | |
|---|---|---|---|---|
| 6,431,822 | B1 | 8/2002 | Schwing | |
| 6,761,144 | B2 * | 7/2004 | Schwam | B64D 27/02 123/242 |
| 7,525,228 | B2 * | 4/2009 | Chuang | F04D 19/007 310/112 |
| 7,614,250 | B2 * | 11/2009 | Sanagi | F04D 25/082 416/181 |
| 2004/0101404 | A1 | 5/2004 | Takemoto | |
| 2005/0249598 | A1 * | 11/2005 | Young | F04D 19/024 416/198 R |
| 2012/0194022 | A1 | 8/2012 | Lau et al. | |
| 2013/0149147 | A1 | 6/2013 | Villella | |
| 2013/0175892 | A1 * | 7/2013 | Buttner | H02K 9/06 310/63 |
| 2014/0241881 | A1 | 8/2014 | Villella | |

FOREIGN PATENT DOCUMENTS

| | | | |
|---|---|---|---|
| CN | 202757214 | U | 2/2013 |
| CN | 203023087 | U | 6/2013 |
| DE | 10028936 | A1 | 12/2001 |
| DE | 202008015714 | U1 | 5/2010 |
| EP | 1622240 | A2 | 2/2006 |
| ES | 2278458 | T3 | 8/2007 |
| JP | 7245914 | A | 9/1995 |
| JP | 9144695 | A | 6/1997 |
| JP | 2005192384 | A | 7/2005 |
| JP | 2011019646 | A | 2/2011 |
| JP | 04916545 | B2 | 4/2012 |
| PL | 216699 | B1 | 5/2014 |

* cited by examiner

FLUID FLOW APPARATUS, FAN ASSEMBLY AND ASSOCIATED METHOD

CROSS REFERENCE TO RELATED APPLICATION

This application is a non-provisional application and claims priority to U.S. Provisional Patent Application 61/888,457 filed Oct. 8, 2013 for "FLUID FLOW SYSTEM, ASSOCIATED ELECTRIC MACHINE AND ASSOCIATED METHOD", which is hereby incorporated by reference in its entirety.

BACKGROUND OF THE INVENTION

The embodiments described herein relate generally to an electric machine with a fluid flow device, and more specifically, to an apparatus and method associated with motor driven blades.

Various types of electric machines are used to rotate a variety of fan blades to generate fluid (such as water or air) flow for a variety of applications. Such applications include airflow and fluid movement in consumer, commercial and industrial applications. One common air flow application is for use to move air in residential and/or commercial heating/ventilation/and air conditioning (HVAC) applications. Other common air flow applications include air flow in connection to refrigeration. A common water flow application is for pumping water in pools, spas, water purification and other commercial applications.

A variety of motors including but not limited to induction, switch reluctance, permanent magnet, alternating current, direct current, a brushless direct current (BLDC) motor and electronically commutated motors may be coupled to fan blades to generate air flow. Motors typically include a rotating member (usually called a rotor) and a stationary member (usually called a stator). Motors typically utilize an electrical input to generate a magnetic field or fields to cause the rotor to rotate. Typically the rotor and/or stator have electrical windings that use the electrical input to generate the magnetic fields. The other of the stator or rotor may have permanent magnets rather than electrical windings to provide magnetic fields. A blade or blades are coupled to the rotor to generate the airflow. The blade or blades often extend from a shaft defining an axis and are called axial fans.

Motor and fan blade designs are often not optimum for their application and lead to inefficiency and noise. Inefficiency and significant noise created when moving air or fluids such as water using an axial fan. Axial fans often create significant amounts of noise and may not move sufficient amounts of air for their application. These Axial fans also create large turning structures or fluid turbulences in the exiting flow that causes system efficiency loss and noise.

The present invention is directed to alleviate at least some of these problems with the prior art.

BRIEF DESCRIPTION OF THE INVENTION

In one aspect, fluid flow device with 2 or more axially separated independent axial fans is provided.

In one aspect, the fluid flow device may be in the form of a fluid pump.

In one aspect, the fluid flow device may be in the form of a fan or fan system.

In one aspect, the device may be in the form of an axial fan or an axial fan system including two or more spaced apart fans.

The axial fans may be spaced apart axially or have variable placement based on operating conditions or system requirements The axial fans may be comprised of axial blades that either co-rotate or counter rotate at various angular velocities. A combination of co-rotating and counter rotating blade sections may be used in any combination.

The axial fans may be comprised of axial blades that either co-rotate or counter rotate at various angular velocities. A combination of co-rotating and counter rotating blade sections may be used in any combination.

The axial fan or fan systems may change rotation during operation.

The axial fan systems may be reversible in rotation during operation. In support of this blades may have variable pitch or flexibility.

The Axial fans may be spaced apart axially or have variable placement based on operating conditions or system requirements. One or more of the axial fan systems may be freely rotating and may provide regenerative energy back to the system.

One or more of the axial fan systems may be comprised of fans with variable blade diameters.

The axial fan systems may be propelled by a single or multiple motors or motor and control of various constructions including radial and axial motor constructions with the possibility of angular velocity or speed control using one or more electronic control units.

The axial fans may be propelled by a combination of fixed angular velocity or speed or variable speed motors.

The axial fan systems may be designed to adjust angular velocity or speed or any significant variable in blade geometry to changing ambient conditions.

Blades of the axial fan systems may be of various pitches or be able to change pitch during operation.

Blades of axial fan systems may be of variable blade geometries including camber, width, angle of attack and diameters.

Blades of axial fan systems may have variable twist along blade in radial directions.

Blades of axial fan systems may be swept up or down along axis of blade rotation.

Blades of axial fan systems may have fixed or variable blade sweeps along the radial direction.

Blades of axial fan systems may be comprised of various combinations of flexible or ridged geometries and may have vanes or surface features, such as textures or vortex generators.

Axial fan systems may be used for various air or fluid moving industrial applications.

Axial fan systems may also be used in generator designs using free rotational power to convert kinetic energy to stored mechanical energy.

Axial fan systems may include edge vortex suppression considerations such as wing tip.

Blades of axial fan geometry may have variable taper along radial length of blade to change flow distribution as necessary.

Axial fan system may be used in fluid mixing applications.

When using two motors the motors may be operated individually and one or the other may be de-energized to save energy when less air flow is needed.

The fan blade(s) are attached radial to the rotor(s) when using an axial machine or motor.

One motor control integral to the fan motor assembly will be able to run both motors independently regarding direction, speed, torque and whether or not they are energized.

When desired, one motor may be placed in locked rotor to prevent the fan from rotating.

When desired one blade may be permitted to freely rotate as in the fluid stream and the associated motor may be used as a generator to create or generate electrical energy from the free rotation or windmill action of the blade.

One motor may be placed in locked rotor to prevent the fan from rotating.

In one embodiment, fluid flow device is described. The fan system uses two or more coaxial blades either co-rotating or counter-rotating or various combinations of rotational direction and angular velocities.

In an aspect of this embodiment, a fan system is driven by 1 or more electric machines.

In an aspect of this embodiment, a motorized fan system is controlled by one or more electronics controls In another embodiment, a fan is described. The fan includes a plurality of blades. At least one of the blades has a length along a direction parallel to the axis of fan rotation. The at least one of the blades has a width transverse to its length. The width of the at least one of the blades is progressive increasing in width in a direction parallel to the axis of fan rotation and in the direction opposed to air flow.

In an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved inertial and dynamic balance.

In another an aspect of this embodiment, the fan is adapted to provide improved flow distribution.

In another an aspect of this embodiment, the fan is adapted to provide reduction of active material.

In another embodiment, a fan is described. The fan includes a plurality of blades. At least one of the blades has a length along a direction parallel to the axis of fan rotation. The at least one of the blades has a width transverse to its length. The width of the at least one of the blades is progressive decreasing in width in a direction parallel to the axis of fan rotation and in the direction of air flow.

In an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved inertial and dynamic balance.

In another an aspect of this embodiment, the fan is adapted to provide improved flow distribution.

In another an aspect of this embodiment, the fan is adapted to provide reduction of active material.

In another an aspect of this embodiment, the fan is adapted to provide improved flow distribution.

In another an aspect of this embodiment, the fan is adapted to provide improved blade assembly stiffness.

In another an aspect of this embodiment, the fan is adapted to provide reduction of active material.

In another an aspect of this embodiment, the fan is adapted to provide improved inertial and dynamic balance.

In another an aspect of this embodiment, the fan system may be used for fluid mixing and separation.

In another an aspect of this embodiment, the fan system may be used for moving or mixing fluids, for example the fans or impellers may be used mix or separate water from petroleum or to propel water or petroleum in the oil and gas industry.

In another an aspect of this embodiment, the fan system may be used improve capacity in a fan system or to provide equivalent capacity in the same area or envelope.

In another an aspect of this embodiment, the fan system may be used as a generator. The fan blades may be caused to rotate by wind milling or due to the fluid stream in which the blades are exposed.

In another an aspect of this embodiment, the fan system may be used as a direct fluid power source. One such fluid power source is the fluid in an expansion valve. A fan blade or impeller may be placed in the cavity of the expansion valve and be caused to rotation by the expanding fluid. The blades or impeller may be connected to a generator to generate electrical or mechanical energy. One such expansion valve is the liquid to gas expansion of refrigeration fluid in an air conditioning system.

In yet another embodiment, a fluid flow device is provided. The device includes a rotation producing device, a first fluid flow device coupled to the rotation producing device and a second fluid flow device coupled to the rotation producing device and spaced from the first fluid flow device.

In yet another aspect, the first fluid flow device is a first fan and the second fluid flow device is a second fan.

In yet another aspect, the rotation producing device is an electric motor.

In yet another aspect, an air flow device is provided. The device includes a motor, a first fan coupled to the motor and a second fan coupled to the motor and spaced from the first fan.

In yet another embodiment, a fluid flow device is provided. The device includes a rotation producing device, a first fluid flow device coupled to the rotation producing device and a second fluid flow device coupled to the rotation producing device and spaced from the first fluid flow device.

In another aspect, the fluid flow device further includes a third fan, coupled to the rotation producing device and spaced from the first fan and the second fan.

In another aspect, the fluid flow device further provide for the first fan to be spaced from the second fan a fan spacing distance and for at least one of the first fan and the second fan to be adjustably coupled to the rotation producing device, such that the fan spacing distance is adjustable.

In another aspect, the fluid flow device further provides for adapting the fluid flow device to provide for adjustment of the fan spacing distance to provide for at least one of optimized air flow, optimized noise reduction, optimized vibration reduction, and optimized efficiency.

In another aspect, the fluid flow device further provides for adapting the rotation producing device to rotate at least one of the first fan and the second fan in a first direction and in a second direction, opposed to the first direction.

In another aspect, the other fan may have a single direction and or angular velocity.

In another aspect, the fluid flow device further provides for adapting the rotation producing device to rotate at least one of the first fan and the second fan in a first direction and in a second direction, opposed to the first direction, during operation and without manual intervention.

In another aspect, the fluid flow device further provides for adapting the rotation producing device to rotate the first fan and the second fan in a first direction and in a second direction, opposed to the first direction, during operation and without manual intervention.

In another aspect, the fluid flow device further provides for adapting the rotation producing device to rotate the first fan and the second fan in a first direction and in a second direction, opposed to the first direction, during operation in a programmed fashion to optimize at least one of efficiency, noise reduction, vibration reduction, and fluid flow.

In another aspect, the fluid flow device further provides for the fan to include at least one blade that has variable pitch or flexibility to optimize at least one of efficiency, noise reduction, vibration reduction, and fluid flow.

In another aspect, the blade may be fixed.

In another aspect, the fluid flow device further provides for adapting the rotation producing device to absorb energy from at least one of the first fan and the second fan.

In another aspect, the fluid flow device further provides for adapting the rotation producing device to include a generator to absorb the energy.

In another aspect, the fluid flow device further provides for adapting the rotation producing device to provide that the absorbed energy is from an expansion valve of an HVAC system.

In another aspect, the fluid flow device further provides that the first fan includes blades of a first diameter and the second fan includes blades of a second diameter, substantially different from the blades of first fan.

In another aspect, the fluid flow device further provides that the first fan defines a first axis of rotation and a first center of mass and that the second fan defines a second center of mass, spaced from the first center of mass.

In another aspect, the fluid flow device further provides that rotation producing device is adapted to rotate the first fan in a first direction and that the rotation producing device is adapted to rotate the second fan in a second direction, opposed to the first direction.

In another aspect, the fluid flow device further provides that the rotation producing device is an axial flux motor.

In another aspect, the fluid flow device further provides that at least one of the first fan and the second fan includes a blade having a proximal portion having a first cross section and a distal portion having a second cross section, the first cross section and the second cross section being substantially different.

In another aspect, the fluid flow device further provides that at least one of the first fan and the second fan includes a flexible blade adapted to provide a first shape at a first rotational angular velocity and a second shape at a second rotational angular velocity, the first and second rotational angular velocities being substantially different and the first shape and the second shape being substantially different.

In another aspect, the fluid flow device further provides that the flexible fan blade includes a fixed central portion fixedly coupled to the rotation producing device a trailing edge extending from the fixed central portion and being moveable between a first position and a second position, the trailing edge being fabricated from a compliant material, the trailing edge being flexible in relation to the fixed central portion between the first position and the second position and a leading edge extending from the fixed central portion in opposed relation to the trailing edge.

In another aspect, the fluid flow device further provides that the first fan has a first fan blade, the second fan has a second fan blade, and the second fan blade is substantially different than the first fan blade.

In another aspect, the fluid flow device further provides that at least one of the first fan and the second fan includes a blade having an arcuate cross section in a plane perpendicular to the longitudinal axis of the blade and that the leading face of the blade is one of concave and convex.

In another aspect, the fluid flow device further provides that rotation producing device includes a first motor for rotation of the first fan in a first direction and a second motor for rotation of the second fan in a second direction, opposed to the first direction.

In another aspect, the fluid flow device further provides that the rotation producing device includes one or more motors and one or more controls for controlling the one or more motors, at least one the controls providing for variable speeds for at least one of the motors.

In another aspect, the fluid flow device further provides that at least one the controls provides for clockwise and counterclockwise rotation of at least one of the motors.

In another aspect, the fluid flow device further provides that one of the first motor and the second motor is one of an induction motor and an electronically commutated motor.

In another aspect, the fluid flow device further provides that the first motor is an induction motor and that the second motor is an electronically commutated motor.

In another aspect, the fluid flow device further provides that the second motor is an axial flux motor In another aspect, the fluid flow device further provides that the axial flux motor includes a stationary member, a first rotary member rotatably connected to the stationary member such that the first rotary member is coupled to the first fan, and a second rotary member rotatably connected to the stationary member and spaced from the first rotary member such that the second rotary member is coupled to the second fan.

In another aspect, the fluid flow device further provides that the stationary member includes a first stationary member including a plurality of coils and a second stationary member including a plurality of coils.

In another aspect, the fluid flow device further provides that the first stationary member and second stationary member are integral with each other.

In another aspect, the fluid flow device further provides that the plurality of coils of the first stationary member and the plurality of coils of the second stationary member are integral with each other.

In another aspect, the fluid flow device further provides that the axial flux motor is adapted to provide a plurality of motor speeds.

In another aspect, the fluid flow device further provides that the axial flux motor is an ECM motor.

In another aspect, the fluid flow device further provides that the stationary member includes a plurality of electromagnetic coils.

In another aspect, the fluid flow device further provides that at least one of the first rotary member and the second rotary member includes a plurality of electromagnetic coils.

In another aspect, the fluid flow device further provides that the first rotary member includes a first plurality of electromagnetic coils and that the second rotary member includes a second plurality of electromagnetic coils.

In another aspect, the fluid flow device further provides that the axial flux motor is adapted to provide a plurality of motor speeds for at least one of the first rotary member and the second rotary member.

In another aspect, the fluid flow device further provides that the axial flux motor is adapted to provide a first motor speed for the first rotary member and that the axial flux motor is adapted to provide a second motor speed for the second rotary member, the second motor speed being substantially different from the first motor speed.

In another embodiment, an electric motor is provided. The electric motor includes a stationary member and a first rotary member rotatably connected to the stationary member. The first rotary member is coupled to the first fan. The electric motor further includes a second rotary member rotatably connected to the stationary member and spaced from the first rotary member. The second rotary member is coupled to the second fan.

In another aspect, the electric motor is one of an induction motor and an electronically commutated motor.

In another aspect, the electric motor provides that at least one of the first rotary member and the second rotary member includes a plurality of permanent magnets.

In another aspect, the electric motor provides that the axial flux motor is adapted to provide a plurality of motor speeds. The speeds can be fixed or variable.

In another aspect, the electric motor provides that the axial flux motor is an ECM motor.

In another aspect, the electric motor provides that at least one of the first rotary member and the second rotary member includes a plurality of electromagnetic coils.

In another aspect, the electric motor provides that the first rotary member includes a plurality of permanent magnets and that the second rotary member includes a plurality of permanent magnets.

In another aspect, the electric motor provides that the axial flux motor first rotary member includes a first plurality of electromagnetic coils and that the second rotary member includes a second plurality of electromagnetic coils.

In another aspect, the axial flux motor is adapted to provide a plurality of motor speeds for at least one of the first rotary member and the second rotary member.

In another aspect, the axial flux motor is adapted to provide a first motor speed for the first rotary member and the axial flux motor is adapted to provide a second motor speed for the second rotary member. The second motor speed is substantially different from the first motor speed.

In another embodiment, a method of providing air flow in a HVAC system is provided. The method includes the steps of providing a rotation producing device, providing a first fan, providing a second fan, securing the first fan to the rotation producing device, and securing the second fan to the rotation producing device in a spaced apart relationship relative to the first fan.

In another aspect of this method, the air flow is over a HVAC heat exchanger, such as a heat exchanger coil, such as a condenser coil.

In another aspect, a method of providing a stream of fluid flow is provided. The method includes the steps of, providing a rotation producing device, providing a first fluid flow device, providing a second fluid flow device, securing the first fluid flow device to the rotation producing device, and securing the second fluid flow device to the rotation producing device in spaced apart relationship relative to the first fluid flow device.

In another aspect of this method, at least one of the first fluid flow device and the second fluid flow device is a pump.

In another aspect of this method, at least one of the first fluid flow device and the second fluid flow device is a fan.

In another aspect of this method, the method further includes providing a controller. The controller provides a signal to at least one of the first flow creating device and the second flow creating device to provide flow at a variable rate.

In another embodiment, a fan is described. The fan includes a plurality of blades. At least one of the blades has a length along a direction parallel to the axis of fan rotation. The at least one of the blades has a width transverse to its length. The width of the at least one of the blades is progressive decreasing in width in a direction parallel to the axis of fan rotation and in the direction of air flow.

In yet another aspect, a device is provided. The device includes a rotation producing device, a first fluid flow device coupled to the rotation producing device and a heat exchanger coupled to the rotation producing device and spaced from the fluid flow device.

In another aspect, the fluid flow device includes a cooling fan

In another aspect, the heat exchanger is a HVAC heat exchanger.

In another aspect, the rotation producing device is an axial flux motor.

In another aspect the rotation producing device includes a housing, a first rotor coupled to the first fluid flow device and a second rotor coupled to the compressor.

In another embodiment of the present invention a fan assembly adapted for use in an outdoor unit of a HVAC application to cool an air conditioning heat exchanger is provided. The fan assembly includes an axial flux motor and a fan rotatably connected to the axial flux motor.

In another aspect the motor of the fan assembly is an electronically commutated motor.

In another embodiment of the present invention a fan assembly is provided. The fan assembly includes a first axial flux motor defining a central opening and a second axial flux motor positioned, as least partially, within the central opening. The fan assembly also includes a first fan rotatably connected to the first axial flux motor and a second fan rotatably connected to the second axial flux motor.

BRIEF DESCRIPTION OF THE DRAWINGS

FIG. 7A is a partial plan view of a blade of the fluid flow device of FIG. 7 showing the orientation of the blade;

DETAILED DESCRIPTION OF THE INVENTION

Due to increased customer and industry demands, reduced noise and vibration, lower costs, and improved performance in capacity and efficiency are desirable in the design and manufacture of fluid moving devices powered by electric motors. The methods, systems, and apparatus described herein facilitate reduced noise and vibration, lower costs, and improved performance in capacity and efficiency for an electric machine. This disclosure provides designs and methods to reduce noise and vibration, lower costs, and improved performance in capacity and efficiency.

Technical effects of the methods, systems, and apparatus described herein include at least one of improved performance and quality and reduced costs.

Figure 1:
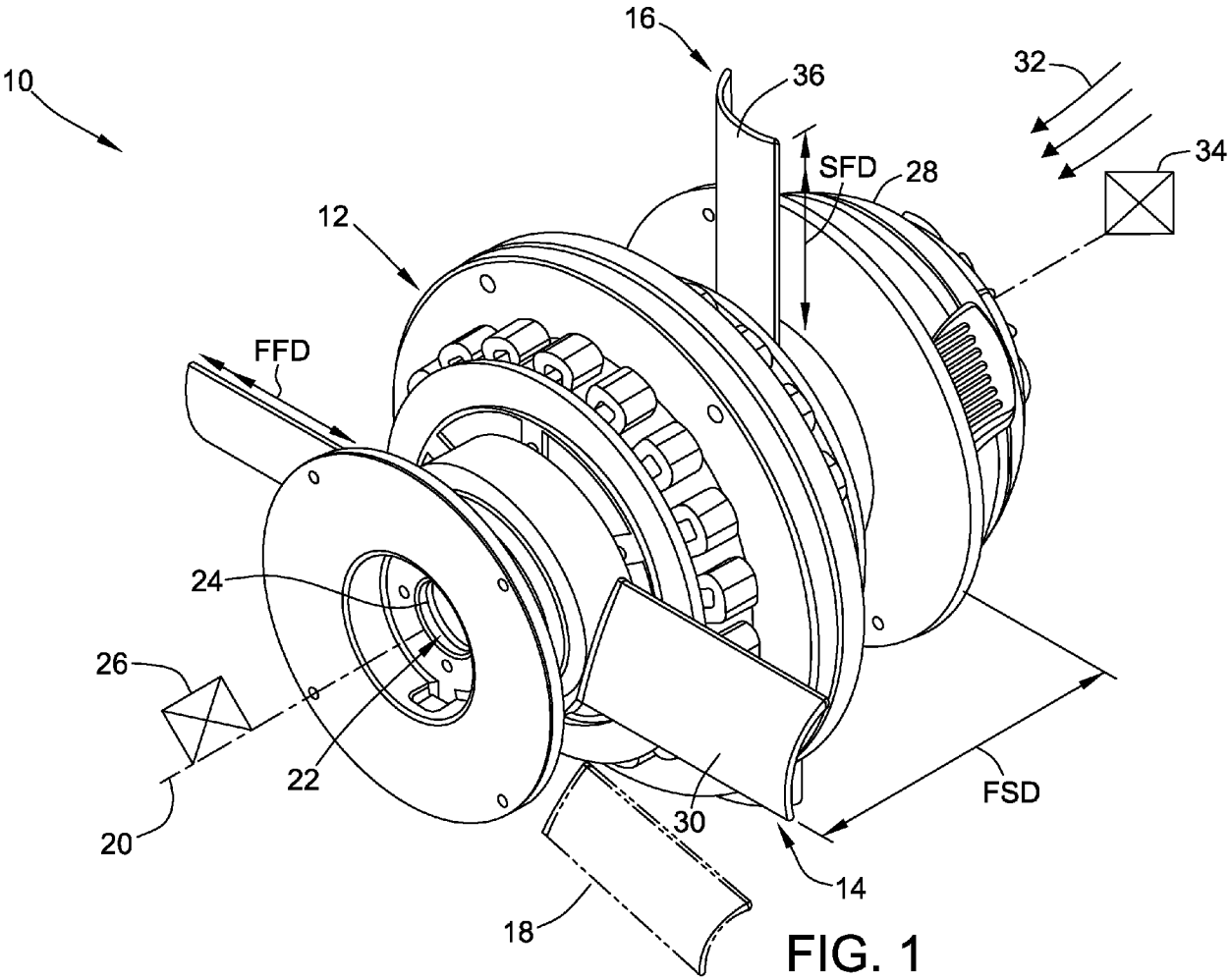
FIG. 1 is a perspective view of an embodiment of the present invention in the form of a fluid flow device with the outer periphery of the device truncated.

Referring now to FIG. 1 a fluid flow system 10 is shown according to an aspect of the present invention. The system 10 includes a rotation producing device 12, a first fluid flow device 14 in the form of for example a first fan 14 coupled to the rotation producing device 10 and a second fluid flow device 16 in the form of for example second fan 16 coupled to the rotation producing device 12 and spaced from the first fan 14. If the fluid flow devices 14 and 16 are in the form of fans, then the fluid flow system 10 may be in the form of a fan system.

The fluid flow system 10 may optionally includes a third fluid flow device 18 in the form of for example third fan 18, coupled to the rotation producing device 12 and spaced from the first fan 14 and the second fan 16.

The fluid flow system 10 may provide for the first fan 14 to be spaced from the second fan 16 a fan spacing distance FSD. The first fan 14 and/or the second fan 16 may be adjustably coupled to the rotation producing device 12 such that the fan spacing distance FSD may be adjusted. Such adjustment may be manual or may be automated.

For example and as shown in FIG. 1, the second fan 16 may be slidably moveable along axis of rotation 20 of second device 16. The second fan may have a central opening 22 which forms a bearing 24 which slides over a central post (not shown). The second fan 16 may be slidably moved along the post by a mechanism 26 that may be manual or as shown automated and controlled by device controller 28.

For example, the fluid flow system 10 may further provide for adapting the fluid flow system 10 to provide for adjustment of the fan spacing distance FSD to provide for at least one of optimized air flow, minimized noise, minimized vibrations and optimized efficiency.

The fluid flow device may optionally further provide for adapting the rotation producing device to rotate at least one of the first fan and the second fan in a first direction and in a second direction, opposed to the first direction. For example the device may include a gearbox (not shown) to cause the first fan 14 to rotate clockwise and to cause the second fan to rotate counterclockwise. The gearbox may also be configured to provide for the first fan 14 and the second fan 16 to both operate in the same direction, either clockwise or counter clockwise or for one fan to idle and the other to be powered or for one fan to operate at a higher or lower rotational angular velocity than the other fan.

The fluid flow device may optionally further provide for running both fan 14 and fan 16 independently regarding direction, angular velocity, torque and whether or not they are energized.

Alternately one of the fans 14 and 16 may have a single direction and or single angular velocity.

Alternately, the fluid flow system 10 may be adapted to cause the rotation producing device 12 to rotate at least one of the first fan and the second fan in a first direction and in a second direction, opposed to the first direction, during operation and without manual intervention. It should be appreciated that such rotation variations could alternately be performed manually or under power with manual assistance. If such rotation variations are provided during operation and without manual intervention they may be done so by providing the device 10 with a rotation producing device 12 in the form of a variable speed and or reversing motor. Such motors may be in the form of for example an ECM motor and may be in the form of an axial flux motor. The ECM motor 12 may be connected to the controller 28 to provide a signal to reverse the direction of the motor 12. The controller 28 may cause the motor 12 to operate in a programmed fashion to optimize at least one of efficiency, minimized noise, minimized vibration, and fluid flow. The controller 28 may provide for running both fan 14 and fan 16 independently regarding direction, speed, torque and whether or not they are energized. It should be appreciated that the first fan and the second fan can provide flows that provide for noise cancellation that can be optimized to provide for optimum noise cancellation. This noise cancellation can also provide for vibration reduction as well.

It should be appreciated that the fan system 10 may include at least one blade, for example blade 30 of first fan 14, that has variable pitch or flexibility to optimize at least one of efficiency, minimized noise, minimized vibration, and fluid flow. It should be appreciated that the pitch or flexibility can provide for noise cancellation that can be optimized to provide for optimum noise cancellation. This noise cancellation can also provide for vibration reduction as well.

Alternately, the blade 30 may be fixed.

It should be appreciated that the fan system 10 may be adapted to provide for at least one fan 12 or 14 to idly rotate in air flow stream 32 such that the fan windmills and the resulting rotation causes a mechanical energy absorbing device 34, for example a generator, to absorb energy from at least one of the first fan 12 and the second fan 14 and to convert the mechanical energy to electrical energy.

As shown the first fan 14 includes first fan blades 30 of a first fan blade diameter HD and the second fan 16 includes second fan blades 36 of a second fan blade diameter SFD.

It should be appreciated that the first fan blade diameter FFD and the second fan blade diameter SFD may be identical, slightly different or substantially different from each other. The first fan blade diameter FFD and the second fan blade diameter SFD may be selected to provide optimum air flow and/or efficiency. The first fan blade diameter FFD and the second fan blade diameter SFD may be selected to provide for noise cancellation/reduction and potential vibration reduction. The first fan blades 30 and the second fan blades 36 may be identical in design, material or cross section or may be different from each other. The design, material or cross section of the first fan blades 30 and the second fan blades 36 may be selected to optimize air flow or efficiency. The design, material or cross section of the first fan blades 30 and the second fan blades 36 may also be selected to provide for noise cancellation/reduction and possible vibration reduction.

The fan system 10 as shown provides that the first fan 14 defines a first fan axis of rotation 37 and a first fan center of mass 38 and that the second fan 16 defines a second fan center of mass 39. The center of mass 38 and the center of mass 39 may coincident or the second fan center of mass 39 may be spaced from the first fan center of mass 38.

It should be appreciated that the first fan 14 and the second fan 16 may includes a blade having a proximal portion having a first cross section and a distal portion having a second cross section, the first cross section and the second cross section being substantially different.

It should be appreciated that the blades 30 of the first fan 14 and the blades 36 of the second fan 16 of the fan system 10 may be in the form of a flexible blade adapted to provide a first shape at a first rotational angular velocity and a second shape at a second rotational angular velocity, the first and second rotational angular velocities being substantially different and the first shape and the second shape being substantially different.

The blades 30 of the first fan 14 and the blades 36 of the second fan 16 of the fan system 10 may as shown have an arcuate cross section in a plane perpendicular to the longitudinal axis of the blade and that the leading face of the blade is one of concave and convex, depending on the direction of rotation of the fans 14 and 16.

It should be appreciated that the first fan 14 may be replaced with a compressor (not shown) and the second fan 16 may be a compressor coil cooling fan. This arrangement may be used to replace the separate traditional compressor motor and separate traditional cooling fan motor used to compress HVAC fluids and to cool condenser coils, respectively in residential HVAC units.

Figure 2:
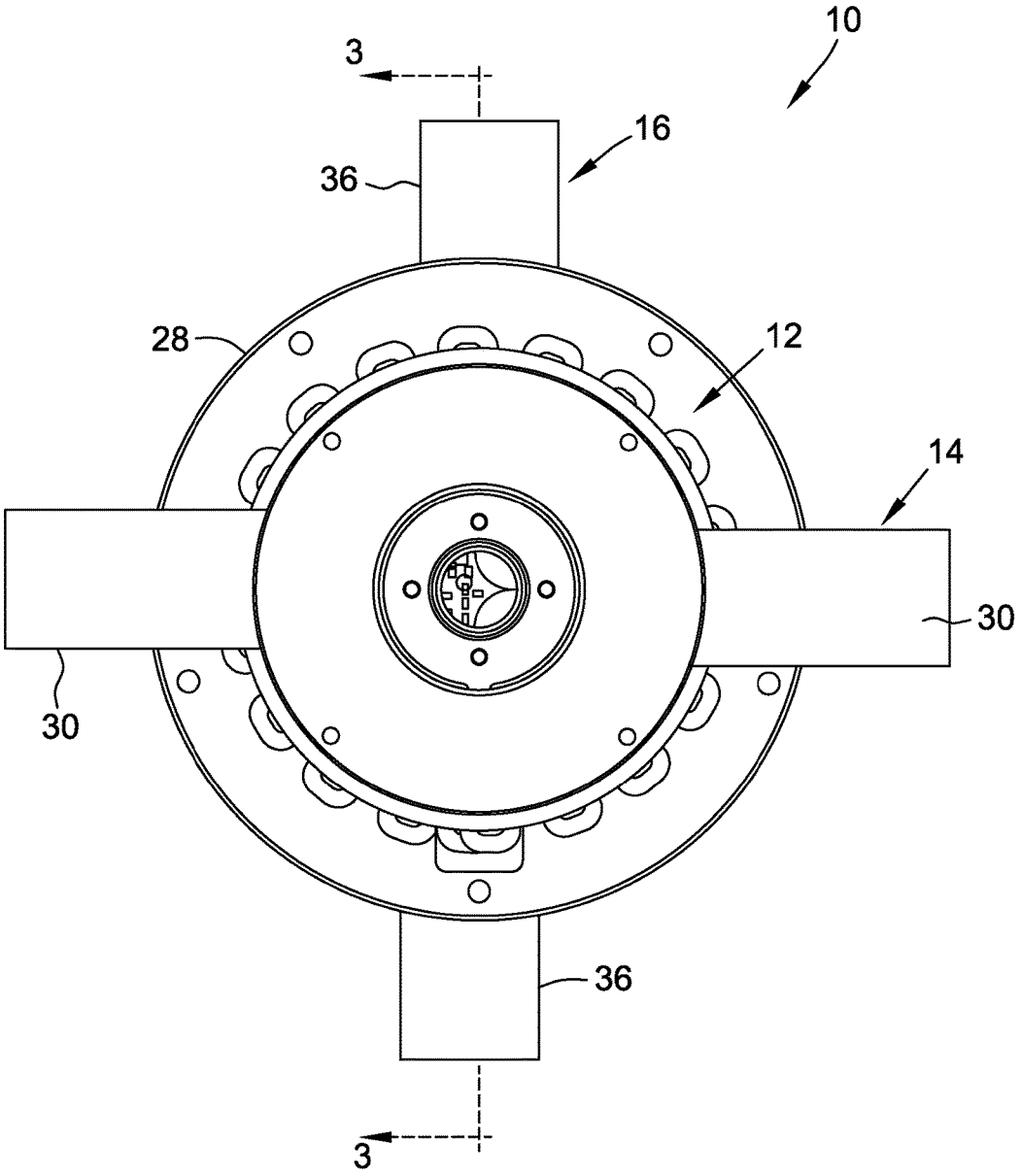
FIG. 2 is a plan view of the fluid flow device of FIG. 1.

Referring now to FIG. 2, the first fan 14 is shown with two opposed blades 30 and the second fan 16 is shown with two opposed blades 36. It should be appreciated that, as shown, the blades 30 and 36 may be identical. Alternatively the blades 30 and 36 may be different in any or all of size, shape, materials or construction. Such difference may be selected to optimize efficiency, flow or noise and may be selected to provide for noise cancellation/reduction and possible vibration reduction. The blades 30 and 36 are as shown spaced 90 degrees from each other, but it should be appreciated that at rest and during rotation the position of the blades may be different. While two blades are shown for each the first and second fans 14 and 16, three, four, five, six or any number of blades may be used for either or both fans and the number of blades may be different for the first and second fans 14 and 16. Such difference may be selected to optimize efficiency, flow or noise cancellation and or reduction.

Figure 3:
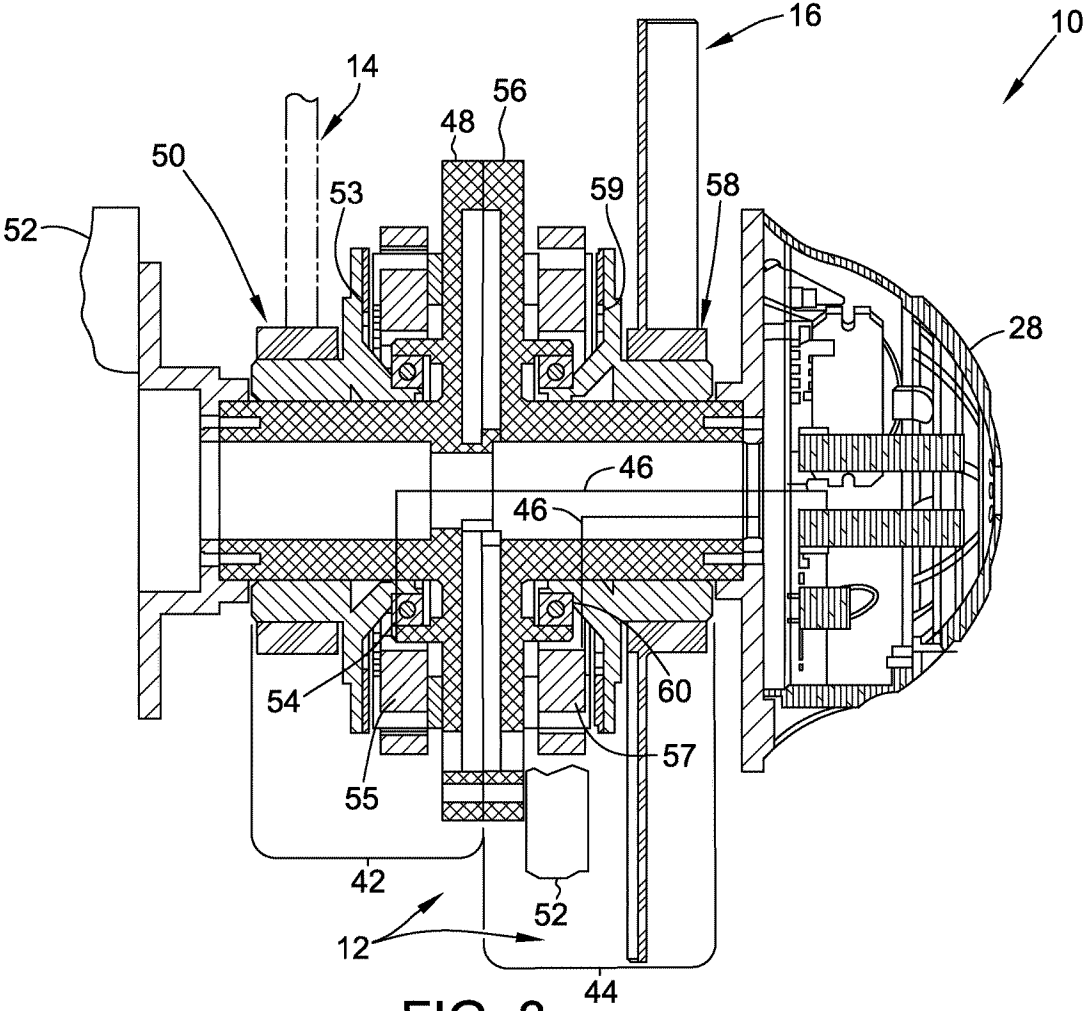
FIG. 3 is a partial cross sectional view of FIG. 2 along the line 3-3 in the direction of the arrows.
Figure 4:
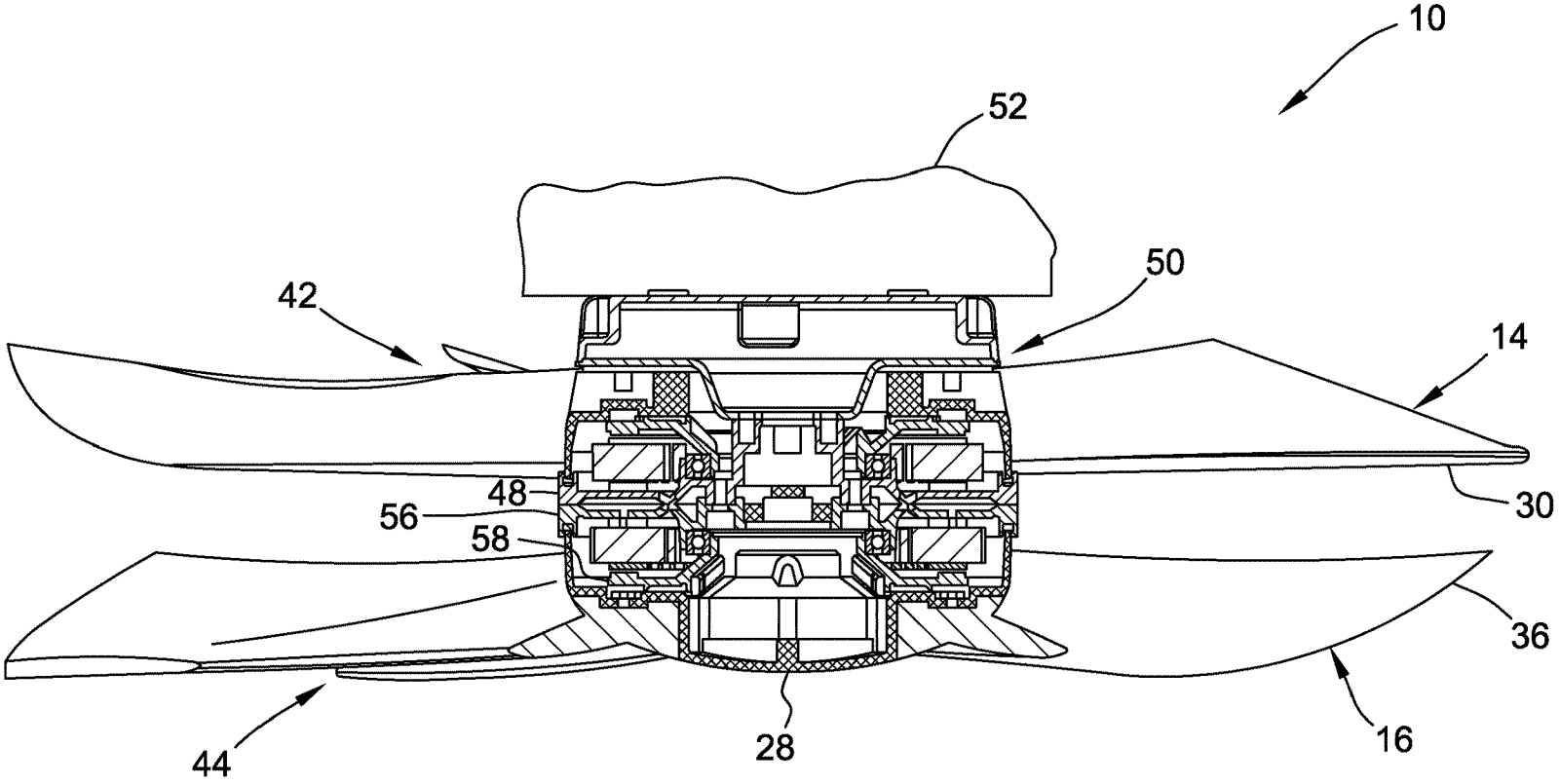
FIG. 4 is a plan view, partially in cross section, of the fluid flow device of FIG. 1.

Referring now to FIGS. 3 and 4, the rotation producing device 12 may include a first motor 42 and a second motor 44. The first and second motors provide for rotation of the first fan 14 and the second fan 16 at different rotational angular velocities and/or directions. The first motor 42 and the second motor 44 provide for running both fan 14 and fan 16 independently regarding direction, angular velocity, torque and whether or not they are energized.

It should be appreciated that the rotation of the first fan 14 and the second fan 16 in different rotational angular velocity and/or directions may be obtained with alternate devices. For example the fan system 10 may include a transmission or gearbox (not shown) positioned between the rotation producing device 12 and the fans 14 and 16. Such a gearbox may provide for each fan operating in different directions, at different angular velocities, as well as, providing idling and locked conditions for each fan, independently or together.

Alternatively the fan system 10 may include a one way clutch (not shown) positioned between the rotation producing device 12 and the fans 14 and 16. Such a one way clutch may provide for each fan operating in different directions, at different angular velocity. The motor 12 would power one of the fans in a first direction and the other fan in the opposite direction reversing directions occasionally to power the fans alternately in their respective directions.

As shown in FIGS. 3 and 4, the controller 28 is electrically connected to the first motor 42 and to the second motor 44 by electrical connections 46. The controller 28 provides for clockwise and counterclockwise rotation of at least one of the motors. It should be appreciated that each motor may have its own controller (not shown).

As shown that first motor 42 and the second motor 44 may be substantially identical. The first motor 42 and the second motor 44 may be any type of motor and may be an AC motor or a DC motor and may, for example, be an induction motor, a PSC motor, a permanent magnet motor, or an electronically commutated motor. The motors 42 and 44 may be radial flux motors, axial flux motors or one of each. As shown in FIG. 3, the motors 42 and 44 are axial flux motors. Axial flux motors are well suited for applications such as in air flow applications where axial distances are preferably minimized. Such applications include ceiling fans and condenser cooling fans.

It should be appreciated that alternatively one of the motors 42 and 44 may be an induction motor and the other motor may be an electronically commutated motor.

It should also be appreciated that alternatively one of the motors 42 and 44 may be a radial flux motor and the other motor may be an axial flux motor.

As shown in FIG. 3, the first axial flux motor 42 includes a first stationary member 48 and a first rotary member 50 rotatably connected to the first stationary member 48 such that the first rotary member 50 is coupled to the first fan 14. The stationary member 48 is fixedly secured to the motor housing (not shown). The motor components may be made of any suitable durable material. Some components or portions thereof require electrically conductive materials and other components or portions thereof require magnetically conductive materials. Some components or portions thereof including portions of the housing may be made of a polymer.

The first stationary member 48 is secured to frame 52 of fan system 10. First bearings in the form of for example first ball bearing 54 permit the rotation of the first rotary member 52 about the first stationary member 48. The first fan 14 is coupled to first rotary member 52. The first stationary member 48 includes a plurality of first coils 55 for providing a magnet field for the first motor 42. The coils 55 are formed by wrapping electrically conductive wire, typically either aluminum or copper or a combination thereof, around a core. It should be appreciated that alternatively permanent magnets may be used to produce the magnet field for the motor. The first rotary member 52 includes a plurality of permanent magnets 53 for providing a magnet field for the first motor 42. It should be appreciated that alternatively a plurality of coils may be used to produce the =pet field for the motor. It should be appreciated that alternatively a combination of coils and magnets on either the rotary member or the stationary member may be used to produce the magnet field(s) for the motor.

As shown in FIG. 3, the second axial flux motor 44 includes a second stationary member 56 and a second rotary member 58 rotatably connected to the second stationary member 56 such that the second rotary member 58 is coupled to the second fan 16.

The second stationary member 56 is secured to frame 52 of fan system 10. Second bearings in the form of for example second ball bearings 60 permit rotation of the second rotary member 58 about the second stationary member 56. The second fan 16 is coupled to second rotary member 58. The second stationary member 56 includes a plurality of second coils 57 for providing a magnet field for the second motor 42. The coils 57 are formed by wrapping electrically conductive wire, typically either aluminum or copper or a combination thereof, around a core. It should be appreciated that alternatively permanent magnets may be used to produce the magnet field for the motor. The second rotary member 58 includes a plurality of second permanent magnets 59 for providing a magnet field for the second motor 42. It should be appreciated that alternatively a plurality of coils may be used to produce the magnet field for the motor. It should be appreciated that alternatively a combination of coils and magnets on either the rotary member or the stationary member may be used to produce the magnet field for the motor.

As shown the first stationary member 46 and the second stationary member 56 are separate components. Alternatively, particularly since both the first stationary member 46 and the second stationary member 56 are inherently stationary and may as shown connected to each other, the first stationary member 46 and the second stationary member 56 may be integral with each other.

While, as shown, the first coils 55 and the second coils 57 are separate, distinct coils, it should be appreciated that the coils 55 and 57 may be configured such as they are shared by both the first rotating member 52 and the second rotating member 58. With such a configuration the two motors 42 and 44 would in effect share a common stationary member. Energizing such common coils properly to affect two completely independent motors may be a challenge, but is theoretically possible.

As shown the axial flux motors 42 and 44 are typically adapted to each independently provide a plurality of motor speeds and provide for idling, locking, clockwise and counterclockwise rotation.

As shown, the axial flux motors 42 and 44 are ECM motors.

Figure 5:
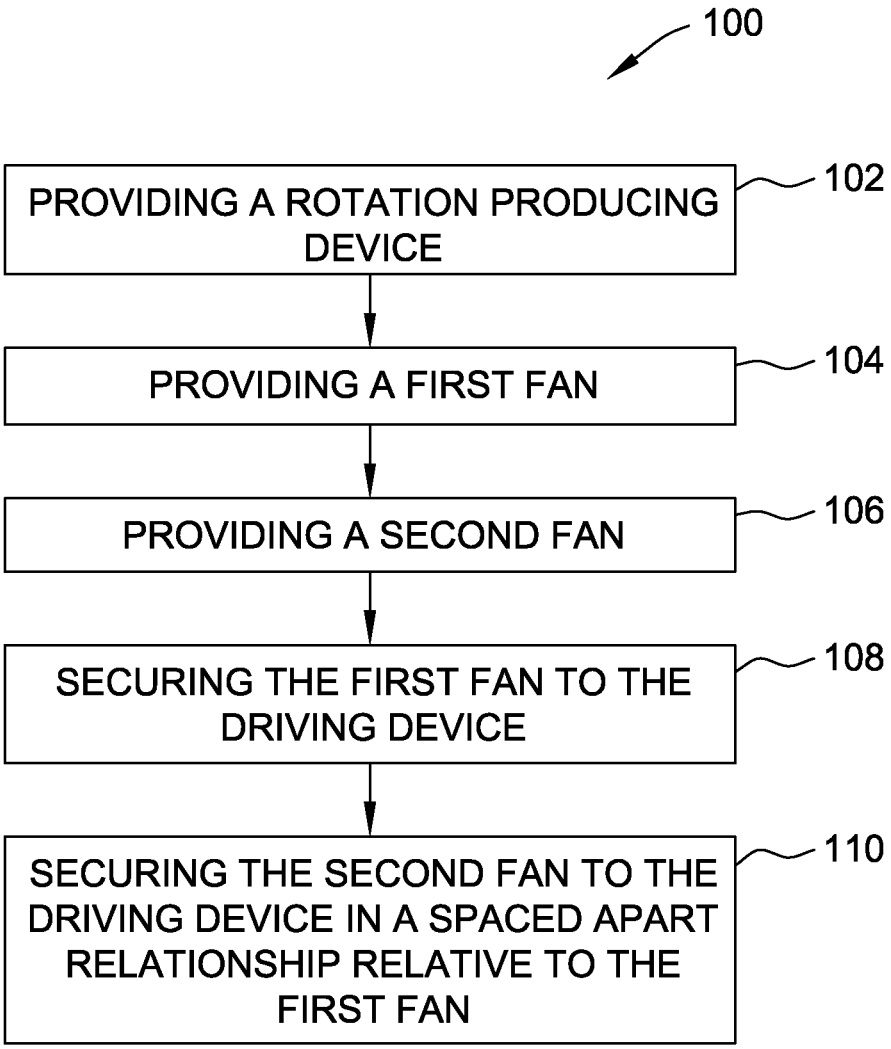
FIG. 5 is a flow chart of an exemplary method for providing a fluid flow device according to another aspect of the present invention.

Referring now to FIG. 5, a method 100 of providing air flow in a HVAC system is provided. The method includes a step 102 of providing a rotation producing device, a step 104 of providing a first fan, a step 106 of providing a second fan, a step 108 of securing the first fan to the rotation producing device, and a step 110 of securing the second fan to the rotation producing device in a spaced apart relationship relative to the first fan.

Figure 6:
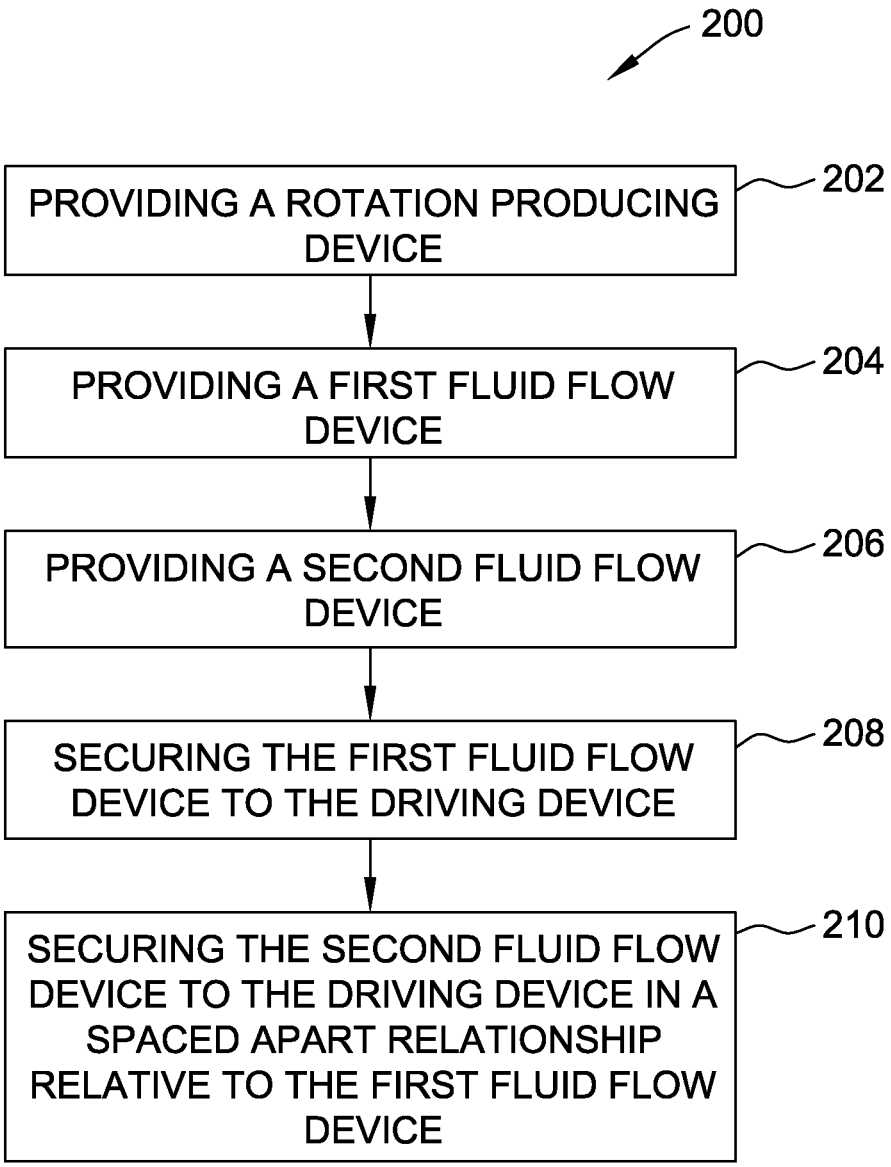
FIG. 6 is a flow chart of another exemplary method for providing a fluid flow device according to another aspect of the present invention.
Figure 6A:
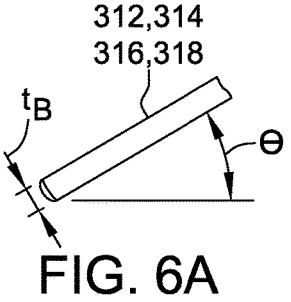

Referring now to FIG. 6, a method 200 of providing a stream of fluid flow is provided. The method 200 includes a step 202 of providing a rotation producing device, a step 204 of providing a first fluid flow system, a step 206 of providing a second fluid flow device, a step 208 of securing the first fluid flow device to the rotation producing device, and a step 210 of securing the second fluid flow device to the rotation producing device in spaced apart relationship relative to the first fluid flow device.

Figure 7:
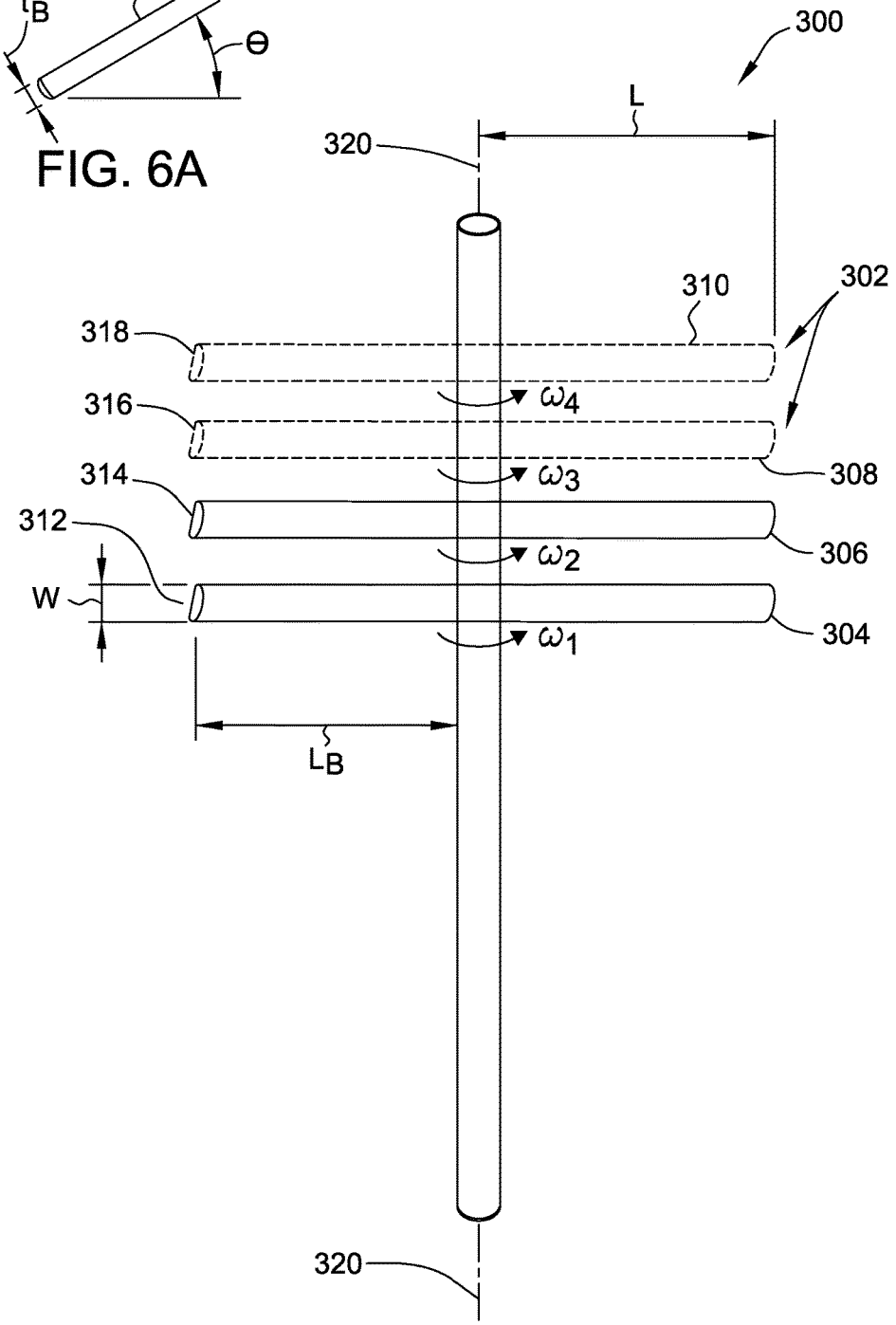
FIG. 7 is a plan view of a fluid for use in a fluid flow device according to another aspect of the present invention.

Referring now to FIG. 7, an embodiment of the invention is shown as an axial fan system 300. The fan system 300 has a plurality of tapered blades 302. It should be appreciated that the fan system 300 may be comprised of multiple rotating blades of alternating or consistent directions.

As shown in FIG. 7, the individual fans 304, 306, 308, 310 of the fan system 300 may rotate in various directions and at various angular velocities w1, w2, w3 and w4.

As shown in FIG. 7, the fans 304, 306, 308, 310 may be places at various axial displacements which may also have the means to change axial location during operation As shown in FIG. 7, the blades 302 including blades 312, 314, 316, and 318, representing fans 304, 306, 308, 310, respectively, may be angles at various angles of attack to the primary flow direction and may change angle during operation.

As shown in FIG. 7, the fans 304, 306, 308, 310 of fan system 300 may be co rotating or counter rotating.

As shown in FIG. 7, there are 4 individual fans comprising the fan system. It should be appreciated that the fan system 300 may include 2, 3, 4, 5 or more individual fans.

As shown in FIG. 7, the fan systems rotate about a common axis 320 of rotation.

As shown in FIG. 7, the length L of the blades 302 in each fan system 300 may be of variable length.

As shown in FIG. 7, the thickness t of the blades in each fan system may be of various thicknesses, or each may be of the same thickness.

Figure 8:
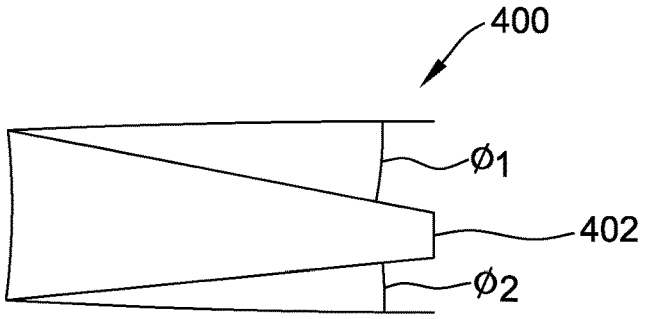
FIG. 8 is a plan view of a blade for use in a fluid flow device according to another aspect of the present invention.

Referring now to FIG. 8, an embodiment of the invention is shown as an axial fan system 400. The fan system 400 has a plurality of tapered blades 402. The taper angles Ø1 and Ø2 may be the same or different.

Figure 9:
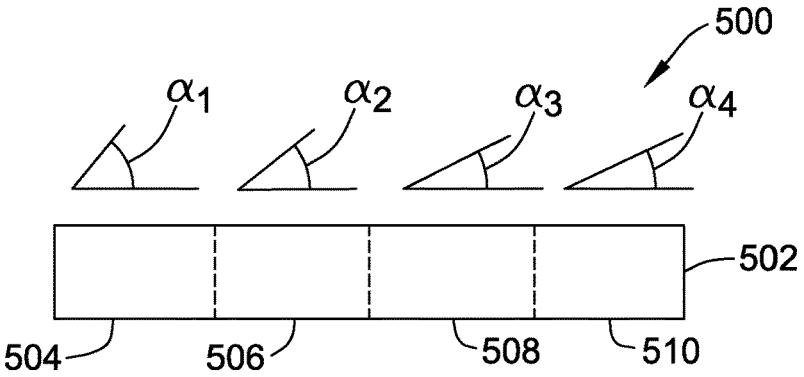
FIG. 9 is a plan view of a blade for use in a fluid flow device according to another aspect of the present invention, showing the twist of the blade.

Referring now to FIG. 9, an embodiment of the invention is shown as an axial fan system 500. The fan system 500 has a plurality of blades 502. At least one of the blades 502 twists. At least one of the blades 502 twists at different angles along the length of the blade. For example the blade 502 has a first zone 504 having an angle of twist of $\alpha 1$ degrees, a second zone 506 having an angle of twist of $\alpha 2$ degrees a third zone 508 having an angle of twist of $\alpha 3$ degrees and a fourth zone 510 having an angle of twist of $\alpha 4$ degrees.

Figure 10:
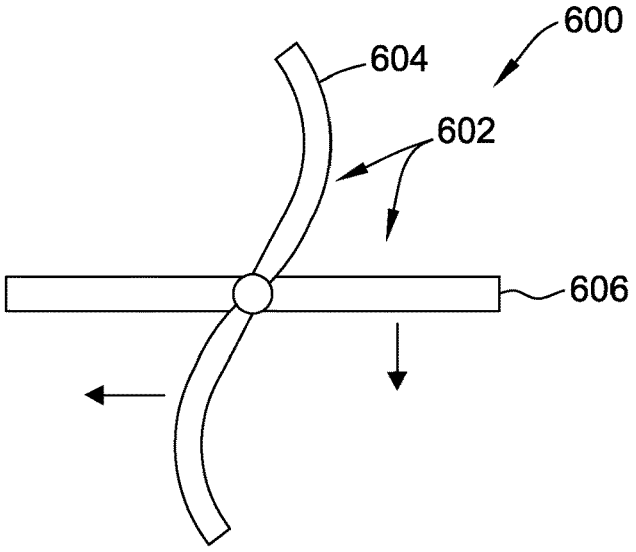
FIG. 10 is a plan view of a blade for use in a fluid flow device according to another aspect of the present invention, showing an exemplary sweep of the blade.

Referring now to FIG. 10, an embodiment of the invention is shown as an axial fan system 600. The fan system 600 has a plurality of blades 602. At least one blade 604 sweeps, or is arcuate, curved or swept. As shown, one blade 606 or more may have zero sweep or be linear or planar.

Figure 11:
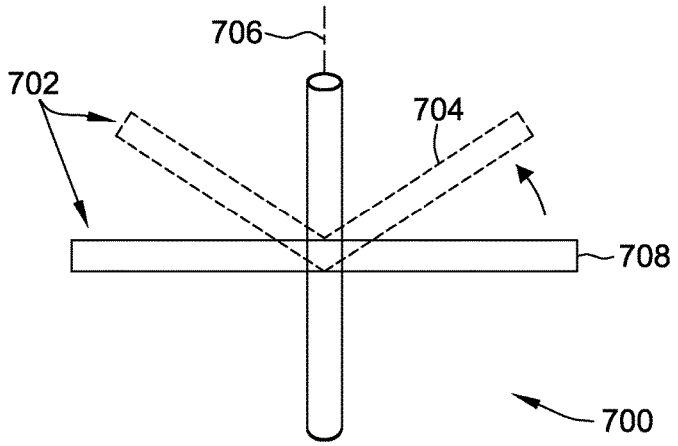
FIG. 11 is a plan view of a blade for use in a fluid flow device according to another aspect of the present invention, showing an exemplary sweep of the blade in the axis of rotation.

Referring now to FIG. 11, an embodiment of the invention is shown as an axial fan system 700. The fan system 600 has a plurality of arcuate, curved or swept blades 702. At least one blade 704 has a sweeping configuration. As shown, one blade 507 or more may have zero sweep or be linear or planar.

Figure 12:
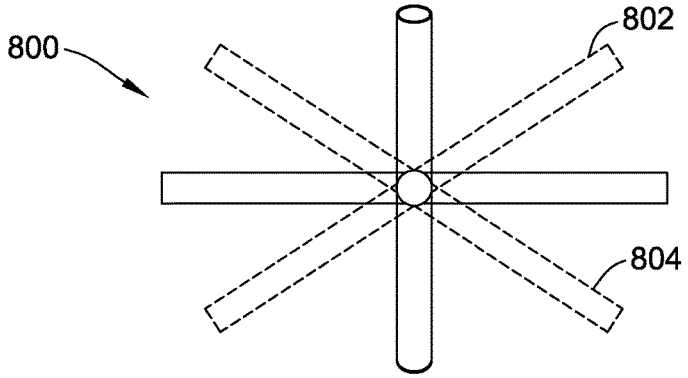
FIG. 12 is a plan view of a pair of blade sets for use in a fluid flow device according to another aspect of the present invention, showing one of the sets of blades in phantom lines.

Referring now to FIG. 12, an embodiment of the invention is shown as a fluid flow system 800. The fluid flow system 800 has a plurality of fan systems. For example the fluid flow system 800 includes a first fan system 802 shown in solid and a second fan system 804 shown in dashed lines.

Figure 13:
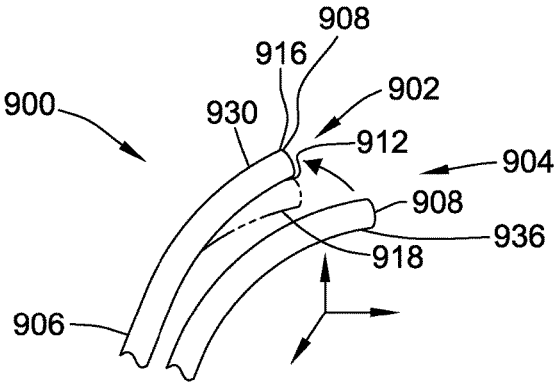
FIG. 13 is a plan view of a flexible blade for use in a fluid flow device according to another aspect of the present invention, showing the blade in different positions as it flexes.

Referring now to FIG. 13, fan system 900 is shown. The fan system 900 includes blades 930 of the first fan 902 and the blades 936 of the second fan 904. The blades 930 and/or 936 may be in the form of a flexible blade adapted to provide a first shape at a first rotational angular velocity and a second shape at a second rotational angular velocity, the first and second rotational angular velocities being substantially different and the first shape and the second shape being substantially different.

The flexible fan blade includes a fixed central portion fixedly coupled to the rotation producing device a trailing edge extending from the fixed central portion 906 and being moveable between a first position 908 and a second position 910, the trailing edge 912 being fabricated from a compliant material. The trailing edge 912 being flexible in relation to the fixed central portion 906 between the first position 908 and the second position 910 and a leading edge 914 extending from the fixed central portion 906 in opposed relation to the trailing edge 912.

Figure 14:
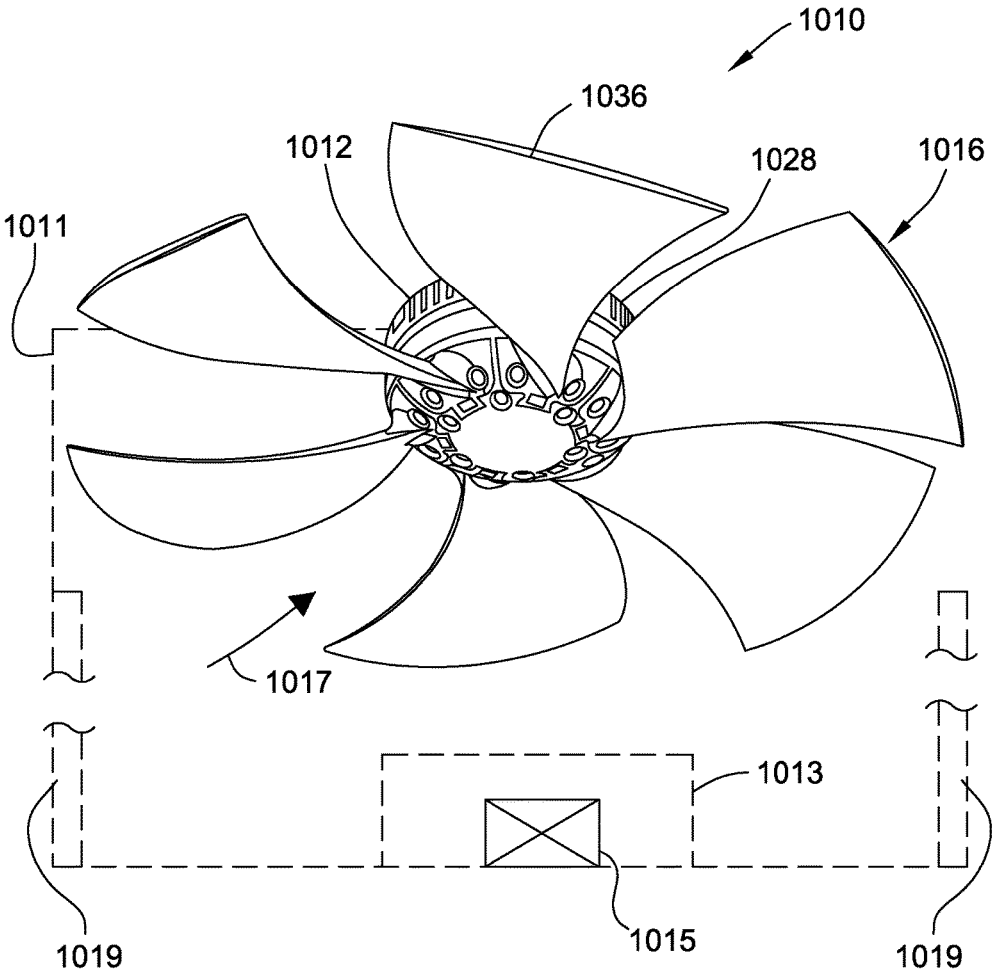
FIG. 14 is a perspective view of another embodiment of the present invention in the form of a fluid flow device having a fan and a motor for use in cooling an outdoor HVAC unit.

Referring now to FIG. 14, HVAC unit 1011 is shown utilizing a fan system 1010 in accordance to another embodiment of the present invention. The fan system 1010 includes a fan motor 1012 which is used to rotate a fan 1016 having a plurality of blades 1036. The fan motor 1012 may be an electronically commutated motor being controlled by controller 1028. The fan motor 1012 may be an axial flux motor. The HVAC unit 1011 may include a compressor 1013 powered by compressor motor 1015 and a heat exchanger 1019 in the form of condenser coils. An axial flux motor provides for reduced axial length of the fan system 1010, permitting more room within the HVAC unit 1011 for an air flow 1017 from fan 1016 for cooling of the condenser coils 1019. The blades 1036 of the fan 1016 provide for the air flow 1017. The fan also provide incidental cooling for the compressor 1013 and the compressor motor 1015. An axial flux motor provides for reduced overall height of the HVAC unit 1011 making a unit less distracting to the appearance of the building being serviced by the HVAC unit and permitting additional units to be shipped in a shipping container, for example in a semi-tractor trailer van.

Figure 15:
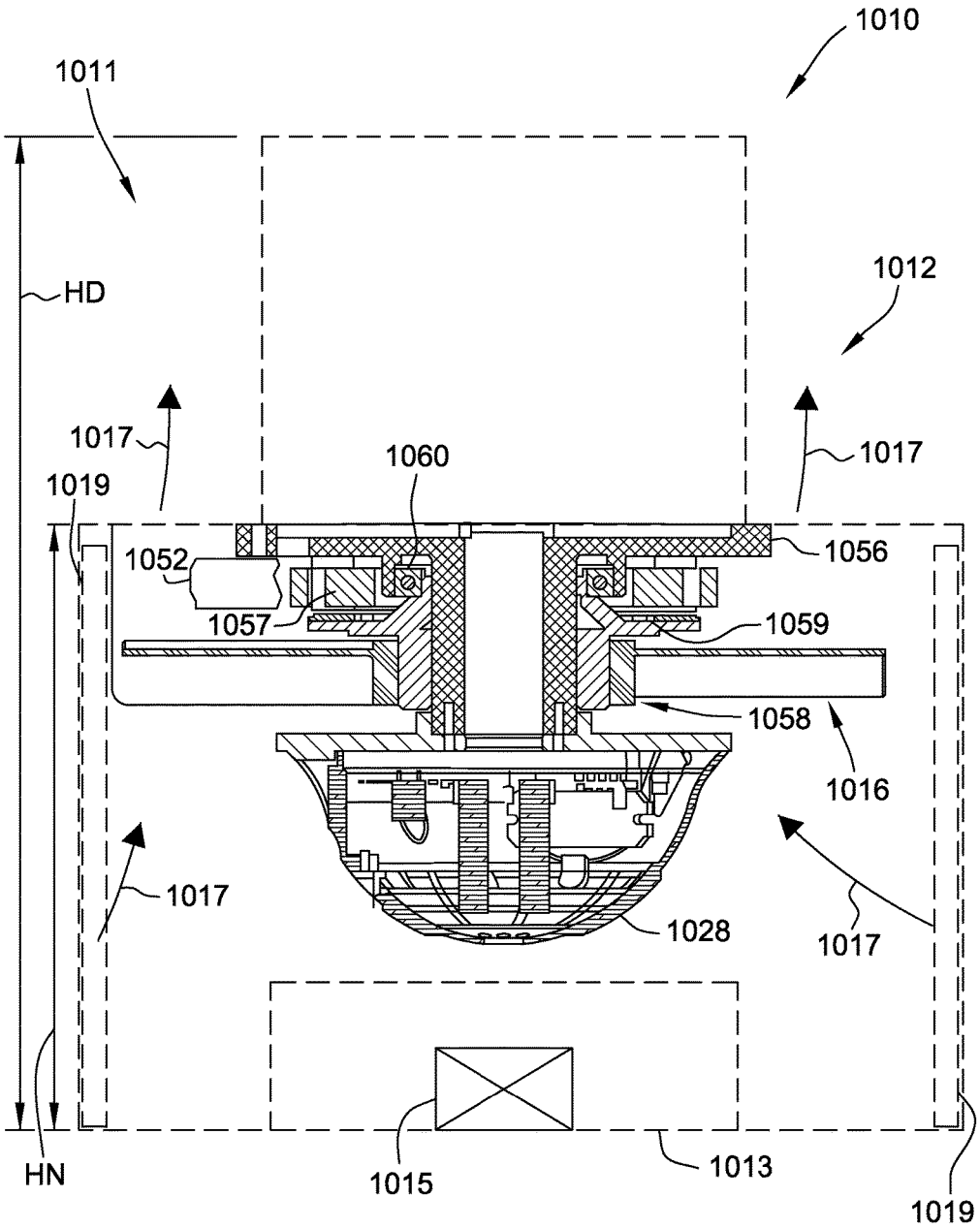
FIG. 15 is a cross sectional view of FIG. 14 showing the motor in greater detail.

Referring now to FIG. 15, the axial motor 1012 includes a stationary member 1056 in the form of a stator and a rotary member 1058 in the form of a rotor rotatably connected to the stator 1056 such that the rotary member 1058 is coupled to the fan 1016.

The stator 1056 is secured to frame 1052 of fan system 1010. Bearings in the form of for example ball bearings 1060 permit rotation of the rotor 1058 about the stator 1056. The fan 1016 is coupled to rotor 1058. The stator 1056 includes a plurality of coils 1057 for providing a magnet field for the motor 1012. The coils 1057 are formed by wrapping electrically conductive wire, typically either aluminum or copper or a combination thereof, around a core. It should be appreciated that alternatively permanent magnets may be used to produce the magnet field for the motor. The rotor 1058 includes a plurality of permanent magnets 1059 for providing a magnet field for the motor 1012. It should be appreciated that alternatively a plurality of coils may be used to produce the magnet field for the motor. It should be appreciated that alternatively a combination of coils and magnets on either the rotary member or the stationary member may be used to produce the magnet field for the motor.

The axial flux motor 1012 may be adapted to provide a plurality of motor speeds and provide for idling, locking, clockwise and counterclockwise rotation.

The axial flux motor 1012 provides for reduced axial length of the fan system 1010, permitting more room within the HVAC unit 1011 for air flow for cooling of the condenser coils 1019. An axial flux motor provides for a new height NH that provides a reduced overall height of the HVAC unit 1011 that is less than the old height OH available with a radial flux motor 1070 (shown in phantom). The axial motor driven fan system 1010 makes a unit less distracting to the appearance of the building being serviced by the HVAC unit and permits the HVAC unit 1011 to be stacked three units high in a semi-tractor trailer van, providing for additional units to be shipped that the number that can be traditionally shipped in a two unit high stacking arrangement previously needed.

Figure 16:
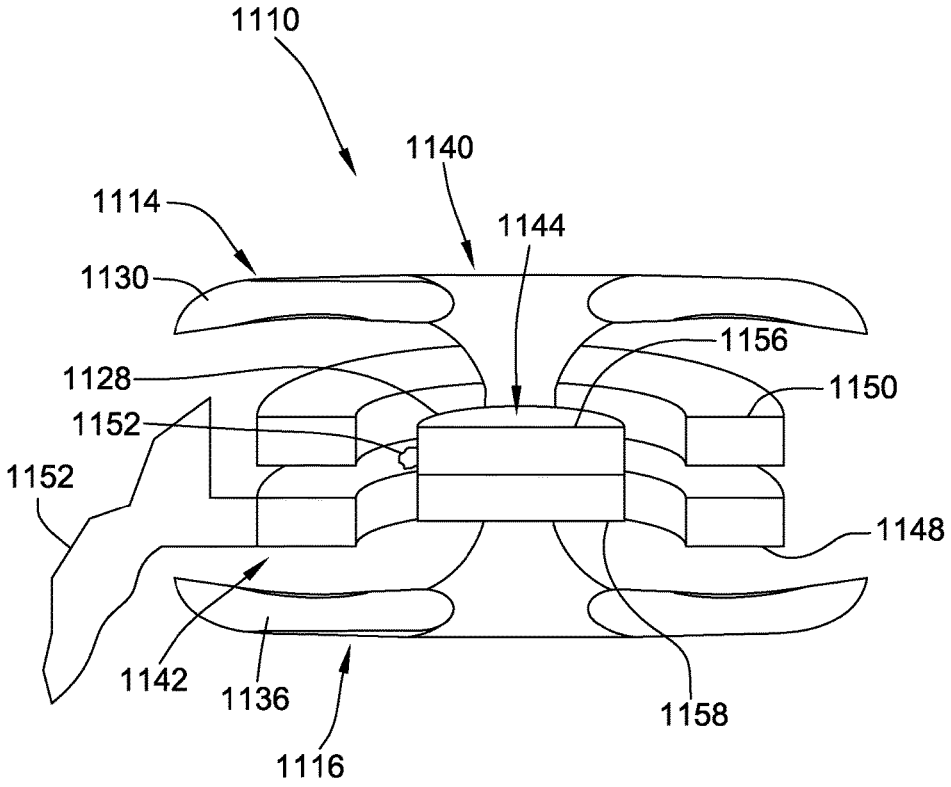
FIG. 16 is cross sectional view of another embodiment of the present invention in the form of a fluid flow device utilizing a second motor that may be at least partially positioned within a first motor.

Referring now to FIG. 16, a fan assembly 1110 is provided. The fan assembly 1110 includes a first axial flux motor 1142 defining a central opening 1140 and a second axial flux motor 1144 positioned, as least partially, within the central opening 1140. Alternatively, the second axial flux motor 1144 may be so much smaller than the first axial flux motor 1142 that the second axial motor may be entirely positioned within the central opening 1140. The fan assembly 1110 also includes a first fan 1114 rotatably connected to the first axial flux motor 1142 and a second fan 1116 rotatably connected to the second axial flux motor 1144. The first axial flux motor 1142 and/or the second axial flux motor 1144 may be electronically controlled by controller 1128.

As shown in FIG. 16, the first axial flux motor 1142 includes a first stationary member or stator 1148 and a first rotary member or rotor 1150 rotatably connected to the first stator 1148 such that the first rotor 1150 is coupled to the first fan 1114. The first stator 1148 is fixedly secured to frame 1152. The first stator 1148 is secured to frame 1152 of fan assembly 1110. First bearings (not shown) in the form of, for example, first ball bearing permit the rotation of the first rotor 1152 about the first stator 1148. The first fan 1114 is coupled to first rotor 1152. The first stator 1148 includes a plurality of first coils (not shown) for providing a magnet field for the first motor 1142. The first coils are formed by wrapping electrically conductive wire, typically either aluminum or copper or a combination thereof, around a core. It should be appreciated that alternatively permanent magnets may be used to produce the magnet field for the motor. The first rotor 1152 includes a plurality of permanent magnets (not shown) for providing a magnet field for the first motor 1142. It should be appreciated that alternatively a plurality of coils may be used to produce the magnet field for the motor. It should be appreciated that alternatively a combination of coils and magnets on either the rotary member or the stationary member may be used to produce the magnet field(s) for the motor.

As shown in FIG. 16, the second axial flux motor 1144 includes a second stator 1156 and a second rotor 1158 rotatably connected to the second stator 1156 such that the second rotor 1158 is coupled to the second fan 1116. The second stator 1156 is secured to frame 1152 of fan system 1110. Second bearings (not shown) in the form of, for example, second ball bearings permit rotation of the second rotor 1158 about the second stator 1156. The second fan 1116 is coupled to second rotor 1158. The second stator 1156 includes a plurality of second coils (not shown) for providing a magnet field for the second motor 1142. The second coils are formed by wrapping electrically conductive wire, typically either aluminum or copper or a combination thereof, around a core. It should be appreciated that alternatively permanent magnets may be used to produce the magnet field for the motor. The second rotor 1158 includes a plurality of second permanent magnets (not shown) for providing a magnet field for the second motor 1142. It should be appreciated that alternatively a plurality of coils may be used to produce the magnet field for the motor. It should be appreciated that alternatively a combination of coils and magnets on either the rotary member or the stationary member may be used to produce the magnet field for the motor.

The central opening 1140 of the first axial flux motor 1142 may permit the second axial flux motor 1144 to be positioned, partially or completely, within the central opening 1140 of the first axial flux motor 1142. The first axial flux motor rotor 1150 and the first axial flux motor stator 1148 may have the central opening 1140 such that the opening 1140 is larger than the outer diameters of both the second axial flux motor rotor 1158 and the second axial flux motor stator 1156. In such case the, second axial flux motor 1144 may be positioned completely within the central opening 1140 of the first axial flux motor 1142.

The methods, systems, and apparatus described herein facilitate efficient and economical assembly of an electric motor. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method step.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing lower cost materials in a permanent magnet motor that reduces or eliminates the efficiency loss caused by the lower cost material. Furthermore, the exemplary methods system and apparatus achieve increased efficiency while reducing or eliminating an increase of the length of the motor. The methods, system and apparatus described herein may be used in any suitable application. However, they are particularly suited for HVAC and pump applications.

Exemplary embodiments of the fluid flow device and system are described above in detail. The electric motor and its components are not limited to the specific embodiments described herein, but rather, components of the systems may be utilized independently and separately from other components described herein. For example, the components may also be used in combination with other motor systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fan, comprising:

a first axial flux motor having a first axial flux motor rotor and a first axial flux motor stator;

a first plurality of fan blades coupled to said first axial flux motor;

a second axial flux motor having a second axial flux motor rotor and a second axial flux motor stator, said second axial flux motor including an operating mode to free wheel when said first motor is energized; and a second plurality of fan blades coupled to the second axial flux motor and spaced from the first plurality of fan blades, the second axial flux motor stator spaced from the first axial flux motor stator, wherein said second axial flux motor includes a generator to absorb the energy transferred from the first plurality of fan blades to the second plurality of fan blades when the second plurality of fan blades is freewheeling while the said first axial flux motor rotates the first plurality of fan blades.

2. The fan in accordance with claim 1, wherein the first plurality of fan blades comprises blades of a first diameter and the second plurality of fan blades comprises blades of a second diameter, substantially different from the blades of first fluid flow device.

3. The fan in accordance with claim 1:

wherein the first plurality of fan blades defines a first axis of rotation and a first center of mass; and wherein the second plurality of fan blades defines a second center of mass, spaced from the first center of mass.

4. The fan in accordance with claim 1, wherein at least one of said first axial motor and said second axial flux motor is an electronically commutated motor.

* * * * *